US009851666B2

(12) United States Patent
Sone

(10) Patent No.: US 9,851,666 B2
(45) **Date of Patent: *Dec. 26, 2017**

(54) FIXING DEVICE AND IMAGE FORMING APPARATUS HAVING THE SAME

(71) Applicants: KABUSHIKI KAISHA TOSHIBA, Tokyo (JP); TOSHIBA TEC KABUSHIKI KAISHA, Tokyo (JP)

(72) Inventor: Toshihiro Sone, Yokohama Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/250,758

(22) Filed: Aug. 29, 2016

(65) Prior Publication Data

US 2017/0090366 A1 Mar. 30, 2017

Related U.S. Application Data

(63) Continuation of application No. 14/867,898, filed on Sep. 28, 2015, now Pat. No. 9,563,160.

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2082; G03G 15/2042; G03G 15/2046
See application file for complete search history.

(56) References Cited

U.S. PATENT DOCUMENTS

| | | | | |
|---|---|---|---|---|
| 5,300,996 | A | 4/1994 | Yokoyama et al. | |
| 5,485,260 | A | 1/1996 | Mitsuya | |
| 5,773,796 | A | 6/1998 | Singer et al. | |
| 5,984,848 | A | 11/1999 | Hyllberg et al. | |
| 6,236,830 | B1 | 5/2001 | Hoberock et al. | |
| 6,336,009 | B1 | 1/2002 | Suzumi et al. | |
| 6,713,726 | B2 | 3/2004 | Tanaka et al. | |
| 8,543,046 | B2 | 9/2013 | Seo et al. | |
| 8,855,542 | B2 | 10/2014 | Sone et al. | |
| 9,122,213 | B2 * | 9/2015 | Kikuchi | G03G 15/2053 |
| 9,563,160 | B1 * | 2/2017 | Sone | G03G 15/2053 |
| 2002/0118984 | A1 | 8/2002 | Lee et al. | |
| 2002/0118985 | A1 | 8/2002 | Lee | |

(Continued)

OTHER PUBLICATIONS

U.S. Appl. No. 14/554,748, filed Nov. 26, 2014.

*Primary Examiner* — Clayton E Laballe
*Assistant Examiner* — Ruifeng Pu
(74) *Attorney, Agent, or Firm* — Patterson & Sheridan, LLP

(57) ABSTRACT

A fixing device includes a fixing unit configured to heat a sheet to fix an image on the sheet, a heating unit configured to heat the fixing unit, and a heat conduction unit disposed adjacent to a heated surface of the fixing unit. The fixing unit includes a first region not in contact with the sheet during heating of the sheet and a second region that is in contact with the heated sheet during heating of the sheet and has a temperature lower than the first region as a result of the contact with the sheet during the heating. The heat conduction unit is configured to transfer heat from the first region to the second region.

20 Claims, 10 Drawing Sheets

(56) References Cited

U.S. PATENT DOCUMENTS

| | | | |
|---|---|---|---|
| 2002/0141775 | A1 | 10/2002 | Mitsuoka et al. |
| 2003/0063931 | A1 | 4/2003 | Sanpei et al. |
| 2006/0045588 | A1 | 3/2006 | Kim et al. |
| 2007/0059062 | A1 | 3/2007 | Endo et al. |
| 2007/0201915 | A1 | 8/2007 | Maeda et al. |
| 2009/0232535 | A1 | 9/2009 | Tsueda et al. |
| 2010/0143009 | A1 | 6/2010 | Kuharik |
| 2011/0217096 | A1 | 9/2011 | Kikuchi et al. |
| 2011/0286775 | A1 | 11/2011 | Ishihara et al. |
| 2012/0057911 | A1 | 3/2012 | Paik |
| 2012/0224875 | A1 | 9/2012 | Kadowaki |
| 2012/0288308 | A1 | 11/2012 | Kobashigawa |
| 2012/0308278 | A1 | 12/2012 | Kikuchi et al. |
| 2013/0071154 | A1 | 3/2013 | Egi |
| 2013/0177340 | A1 | 7/2013 | Kawata et al. |
| 2013/0183072 | A1 | 7/2013 | Hase et al. |
| 2014/0119787 | A1 | 5/2014 | Hasegawa |
| 2014/0161497 | A1 | 6/2014 | Lee et al. |
| 2014/0169845 | A1 | 6/2014 | Nakahara et al. |
| 2014/0294471 | A1 | 10/2014 | Lee et al. |
| 2014/0314457 | A1 | 10/2014 | Kikuchi |
| 2015/0063883 | A1 | 3/2015 | Nakano |
| 2015/0063885 | A1 | 3/2015 | Mitani et al. |
| 2015/0098737 | A1 | 4/2015 | Matsumoto et al. |
| 2015/0104227 | A1 | 4/2015 | Shimokawa et al. |
| 2015/0104228 | A1 | 4/2015 | Moriguchi |
| 2015/0110529 | A1 | 4/2015 | Sone et al. |
| 2015/0248090 | A1 | 9/2015 | Yamamoto |
| 2015/0261157 | A1 | 9/2015 | Yamano et al. |
| 2015/0293482 | A1 | 10/2015 | Takahashi et al. |
| 2015/0346662 | A1 | 12/2015 | Kawarasaki et al. |

* cited by examiner

FIXING DEVICE AND IMAGE FORMING APPARATUS HAVING THE SAME

CROSS-REFERENCE TO RELATED APPLICATION

This application is a continuation of U.S. patent application Ser. No. 14/867,898, filed on Sep. 28, 2015, the entire contents of which are incorporated herein by reference.

FIELD

Embodiments described herein relate generally to a fixing device and an image forming apparatus having the same.

BACKGROUND

An image forming apparatus such as a multi-function peripheral (MFP) or a printer includes a fixing device. The fixing device includes a fixing unit from which heat is transferred to a sheet having an image thereon to fix the image to the sheet, while the sheet passes through the fixing unit. The fixing unit includes, for example, a roller and an endless belt.

In general, there is a trade-off between maintaining uniformity of temperature across different positions of the fixing unit and the energy consumed by the fixing unit. When the heat capacity of the fixing unit is large, the fixing unit can be maintained uniformly at the fixing temperature even though heat is transferred to sheets as they are passed therethrough. However, when the heat capacity of the fixing unit increases, energy required to heat the fixing unit also increases. On the other hand, when the heat capacity of the fixing unit is small, the fixing unit may have a temperature difference between a region through which the sheet passes and a region through which no sheet passes. As a plurality of sheets passes through the fixing unit, the temperature of the region through which no sheet passes may become excessively high.

DETAILED DESCRIPTION

Figure 1:
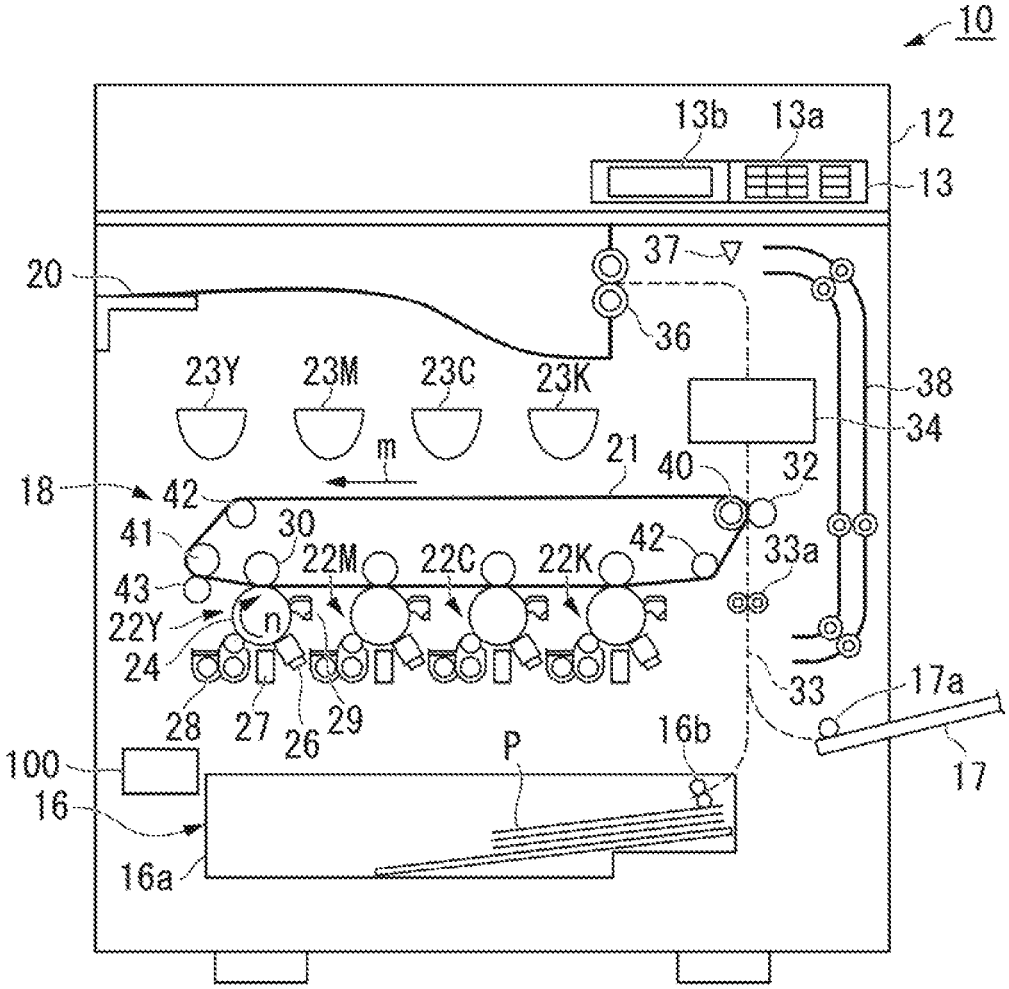
FIG. 1 schematically illustrates an image forming apparatus according to a first embodiment.

According to one embodiment, a fixing device includes a fixing unit configured to heat a sheet to fix an image on the sheet, a heating unit configured to heat the fixing unit, and a heat conduction unit disposed adjacent to a heated surface of the fixing unit. The fixing unit includes a first region not in contact with the sheet during heating of the sheet and a second region that is in contact with the heated sheet during heating of the sheet and has a temperature lower than the first region as a result of the contact with the sheet during the heating. The heat conduction unit is configured to transfer heat from the first region to the second region.

Hereinafter, an image forming apparatus 10 according to the first embodiment will be described with reference to the drawings. In the drawings, the same components are depicted using same reference numerals.

FIG. 1 schematically illustrates the image forming apparatus 10 according to the first embodiment. Hereinafter, a multi-function peripheral (MFP) is described as an example of the image forming apparatus 10.

As illustrated in FIG. 1, the MFP 10 includes a scanner 12, a control panel 13, a feed cassette unit 16, a feed tray 17, a printer unit 18, and an output unit 20. The MFP 10 includes a CPU 100 which controls the entire MFP 10. The CPU 100 controls a main control circuit 201 (refer to FIG. 2).

The scanner 12 reads an image of an original. The control panel 13 includes input keys 13*a* and a display unit 13*b*. For example, the input keys 13*a* receive inputs by a user. For example, the display unit 13*b* is a touch panel. The display unit 13*b* receives inputs by the user and displays information to the user.

The feed cassette unit 16 includes a feed cassette 16*a* and a pickup roller 16*b*. The feed cassette 16*a* stores a sheet P, which serves as the recording medium. The pickup roller 16*b* picks up the sheet P from the feed cassette 16*a*.

The feed cassette 16*a* stores an unused sheet P. The feed tray 17 holds unused paper P to be fed using the pickup roller 17*a*.

The printer unit 18 forms the image of the original read by the scanner 12. The printer unit 18 includes an intermediate transfer belt 21. The printer unit 18 supports the intermediate transfer belt 21 using a backup roller 40, a driven roller 41, and a plurality of tension rollers 42. The backup roller 40 includes a drive unit (not shown). The printer unit 18 rotates the intermediate transfer belt 21 in the direction of an arrow m.

The printer unit 18 includes four image forming stations 22Y, 22M, 22C, and 22K. Each of the image forming stations 22Y, 22M, 22C, and 22K is used to forma an image of yellow (Y), magenta (M), cyan (C), and black (K), respectively. The image forming stations 22Y, 22M, 22C, and 22K are arranged in a line along a rotational direction of the intermediate transfer belt 21 on the bottom side thereof.

Above each of the image forming stations 22Y, 22M, 22C, and 22K, the printer unit 18 includes cartridges 23Y, 23M, 23C, and 23K, respectively. Each of the cartridges 23Y, 23M, 23C, and 23K stores a toner which is supplied to form images of yellow (Y), magenta (M), cyan (C), and black (K), respectively.

Hereinafter, among the image forming stations 22Y, 22M, 22C, and 22K, the image forming station 22Y of yellow (Y) will be described as an example. Since the image forming stations 22M, 22C, and 22K have the same configurations as the image forming station 22Y, detailed description thereof will be omitted.

The image forming station 22Y includes a charger 26, an exposure scanning head 27, a developer device 28, and a photoreceptor cleaner 29. The charger 26, the exposure scanning head 27, the developer device 28, and the photoreceptor cleaner 29 are arranged around a photoreceptor drum 24 which rotates in the direction of an arrow n.

The image forming station 22Y includes a primary transfer roller 30. The primary transfer roller 30 faces the photoreceptor drum 24 across the intermediate transfer belt 21.

The image forming station 22Y exposes the photoreceptor drum 24 using the exposure scanning head 27 after the charger 26 charges the photoreceptor drum 24. The image forming station 22Y forms an electrostatic latent image on the photoreceptor drum 24. The developer device 28 develops the electrostatic latent image on the photoreceptor drum 24 using a two component developer formed of a toner and a carrier.

The primary transfer roller 30 performs the primary transfer of the toner image formed on the photoreceptor drum 24 onto the intermediate transfer belt 21. The image forming stations 22Y, 22M, 22C, and 22K form a color toner image on the intermediate transfer belt 21 using the primary transfer roller 30. The color toner image is formed by sequentially overlapping the yellow (Y), magenta (M), cyan (C), and black (K) toner images. The photoreceptor cleaner 29 removes the remaining toner from the photoreceptor drum 24 after the primary transfer.

The printer unit 18 includes a secondary transfer roller 32. The secondary transfer roller 32 faces the backup roller 40 across the intermediate transfer belt 21. The secondary transfer roller 32 performs the secondary transfer of the color toner image on the intermediate transfer belt 21 onto the sheet P. The sheet P is fed along a transport path 33 from the feed cassette unit 16 or a manual feed tray 17.

The printer unit 18 includes a belt cleaner 43 which faces the driven roller 41 across the intermediate transfer belt 21. The belt cleaner 43 removes toner remaining on the intermediate transfer belt 21 after the secondary transfer. Here, an image forming unit includes the intermediate transfer belt 21, four image forming stations 22Y, 22M, 22C, 22K, and the secondary transfer roller 32.

In the printer unit 18, a resist roller 33*a*, a fixing device 34, and an output roller 36 are provided along the transport path 33. The printer unit 18 also includes a branching unit 37 and an inversion transport unit 38 downstream of the fixing device 34 along a sheet transportation direction. After the fixing, the branching unit 37 feeds the sheet P to the output unit 20 or the inversion transport unit 38. When performing duplex printing, the inversion transport unit 38 inverts the sheet P fed from the branching unit 37 and transports the sheet P in the direction of the resist roller 33*a*. The MFP 10 forms a toner image fixed on the sheet P using the printer unit 18. The MFP 10 outputs the sheet P on which the fixed toner image is formed to the output unit 20.

The sheet P is transported along the transport path 33 from the feed cassette unit 16 or the manual feed tray 17 (hereinafter, "feed unit") to the output unit 20. Hereinafter, the feed unit side is the upstream side in relation to the sheet transportation direction. The feed unit side is the upstream side in relation to a rotational direction u (described below). Hereinafter, the output unit 20 side is the downstream side in relation to the sheet transportation direction. The output unit 20 side is the downstream side in relation to the rotational direction u (described below).

Here, the MFP 10 is not limited to a tandem development system, and the number of developer devices 28 is also not limited. The MFP 10 may directly transfer a toner image from the photoreceptor drum 24 onto the sheet P.

Hereinafter, the fixing device 34 will be description in detail.

Figure 2:
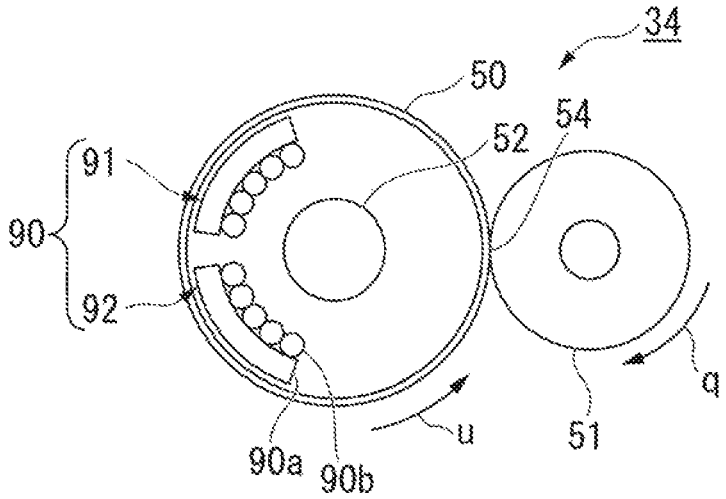
FIG. 2 is a side view of a fixing device in the image forming apparatus according to the first embodiment.

FIG. 2 is a side view of the fixing device 34 according to the first embodiment.

As illustrated in FIG. 2, the fixing device 34 includes a heat roller 50, a press roller 51, a lamp 52 (a heating unit), and a uniform heating member 90.

The heat roller 50 is an endless fixing member. The heat roller 50 is cylindrically shaped. The heat roller 50 includes a metal roller. For example, the heat roller 50 includes a layer of a fluoride resin or the like on the outer circumferential surface of an aluminum roller which has a thickness of approximately 0.8 mm. The heat roller 50 is driven by the press roller 51 to rotate in the direction of the arrow u. Alternatively, the heat roller 50 may be driven independently from the press roller 51 in the direction of the arrow u.

The press roller 51 is a pressure application unit which applies a pressure to the heat roller 50. The press roller 51 rotates in the direction of an arrow q by a motor (not shown). For example, the press roller 51 includes an elastic layer such as silicon rubber on the outer circumferential surface of a steel roller.

The heat roller 50 and the press roller 51 face each other. A nip 54 is formed between the heat roller 50 and the press roller 51. The press roller 51 is urged toward the heat roller 50. The press roller 51 and the heat roller 50 form the nip 54 by the press roller 51 being pressed against the heat roller 50. The sheet P (refer to FIG. 1) passes along the transport path 33 and through the nip 54 between the heat roller 50 and the press roller 51. In the present embodiment, the heat roller 50 is not urged toward the press roller 51. That is, the position of the heat roller 50 is fixed.

The lamp 52 is disposed in the heat roller 50. One lamp 52 is arranged. The lamp 52 heats the heat roller 50. For example, the temperature of the heat roller 50 is configured to be at approximately 165° C. by heating the lamp 52. The lamp 52 faces the heat roller 50 in the thickness direction. The lamp 52 is long in the width direction (hereinafter "roller width direction") of the heat roller 50. The length of the lamp 52 in the longitudinal direction is approximately the same as the length of the heat roller 50 in the roller width direction.

The uniform heating member 90 is positioned in a region surrounded by the heat roller 50. The uniform heating member 90 is configured to cause temperatures of the heat roller 50 to be more uniform within the surface thereof. The uniform heating member 90 faces the heat roller 50 in the thickness direction. The uniform heating member 90 is positioned between the lamp 52 and the inner circumferential surface of the heat roller 50 in the radial direction of the heat roller 50. The uniform heating member 90 is arc-shaped along the inner circumferential surface of the heat roller 50.

The uniform heating member 90 includes a first uniform heating member 91 and a second uniform heating member 92. The first uniform heating member 91 and the second uniform heating member 92 are arranged such that heat may transfer therebetween. The first uniform heating member 91 is separated from the second uniform heating member 92. The first uniform heating member 91 is positioned on the upstream side in the rotational direction u of the heat roller 50 relative to the second uniform heating member 92.

Hereinafter, the surfaces of the first uniform heating member 91 and the second uniform heating member 92 facing the heat roller 50 will be referred to as "radial outer surfaces." The radial outer surfaces of the first uniform heating member 91 and the second uniform heating member 92 are apart from the inner circumferential surface of the heat roller 50. For example, a gap between the radial outer surfaces of the first uniform heating member 91 and the second uniform heating member 92 and the inner circumferential surface of the heat roller 50 is approximately 1 mm to 2 mm.

Hereinafter, a control system 110 of the heat roller 50 will be described in detail.

Figure 3:
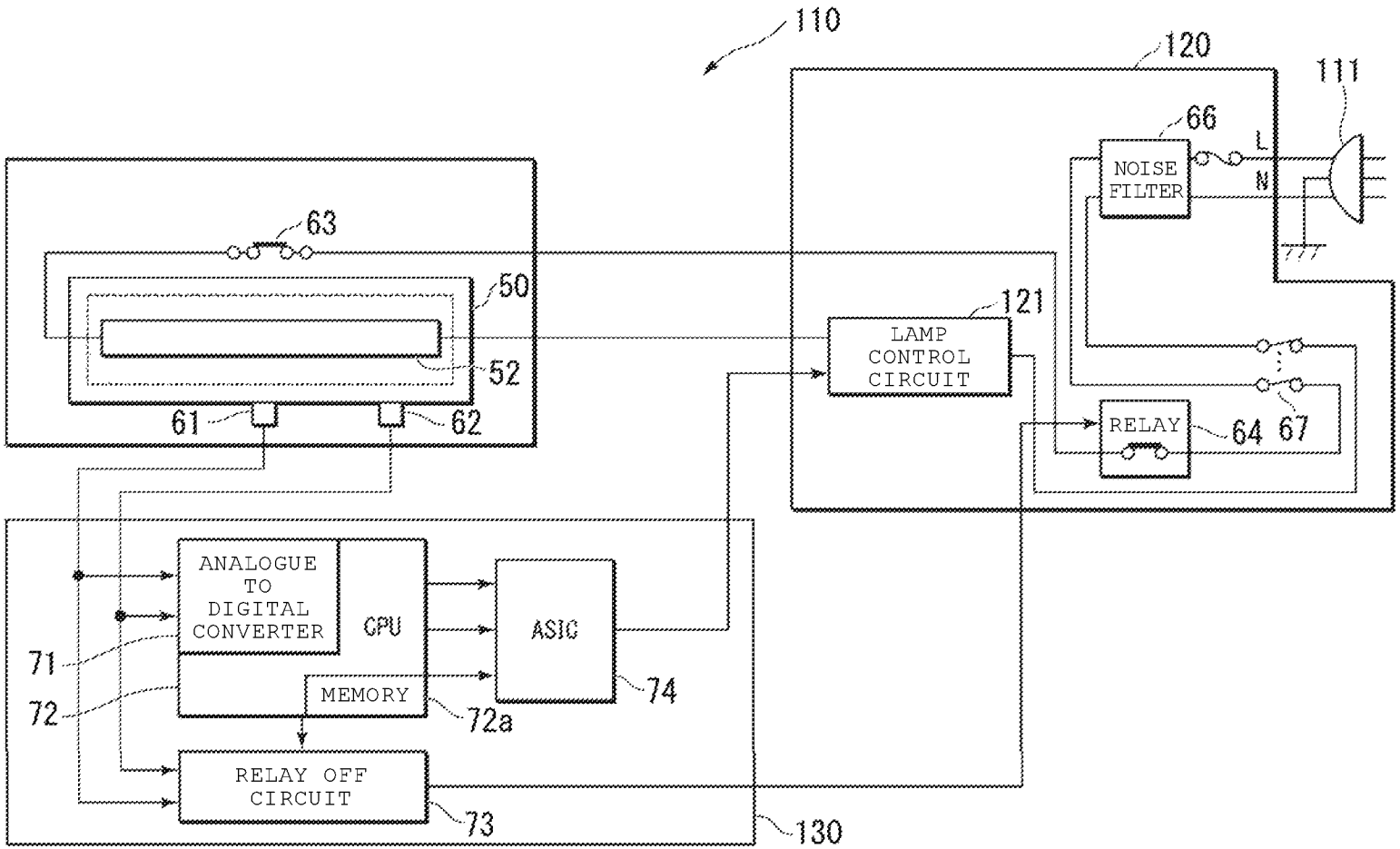
FIG. 3 is a block diagram of a control system of a heat roller in the image forming apparatus according to the first embodiment.

FIG. 3 is a block diagram illustrating the control system 110 of the heat roller 50 according to the first embodiment.

As illustrated in FIG. 3, the control system 110 includes a switching circuit 120 and a heater control unit 130. The switching circuit 120 controls supply of power from a power source 111 to the lamp 52. The heater control unit 130 feeds back detection results of a center thermistor 61 and an edge thermistor 62 to the switching circuit 120. The center thermistor 61 and the edge thermistor 62 detect the temperatures of the heat roller 50. The center thermistor 61 is positioned in the center of the heat roller 50 in the roller width direction. The edge thermistor 62 is positioned at the end portion of the heat roller 50 in the roller width direction. The center thermistor 61 and the edge thermistor 62 are positioned on the outer circumferential side of the heat roller 50.

A thermostat 63 functions as a safety device of the fixing device 34. The thermostat 63 operates when the heat roller 50 is overheated and the temperature thereof rises to a cutoff threshold. In such a case, power supply to the lamp 52 is cut off by the operation of the thermostat 63.

The switching circuit 120 includes a lamp control circuit 121. The lamp control circuit 121 controls the lamp 52. The lamp control circuit 121 is connected to the power source 111 via a relay 64, a noise filter 66, and a power switch 67.

The heater control unit 130 includes an analogue to digital converter 71, a CPU 72, a relay off circuit 73, and an ASIC 74. The CPU 72 includes a memory 72*a*. The ASIC 74 controls power supply to the lamp control circuit 121 based on the detection results of the center thermistor 61 and the edge thermistor 62.

The ASIC 74 controls heat generation by the lamp 52 by controlling the power supply to the lamp control circuit 121. The ASIC 74 controls the temperature of the heat roller 50 by controlling the heat generation by the lamp 52. The ASIC 74 maintains a fixing temperature by controlling the heat generation by the heat roller 50.

Hereinafter, the uniform heating member 90 will be described in detail.

Figure 4:
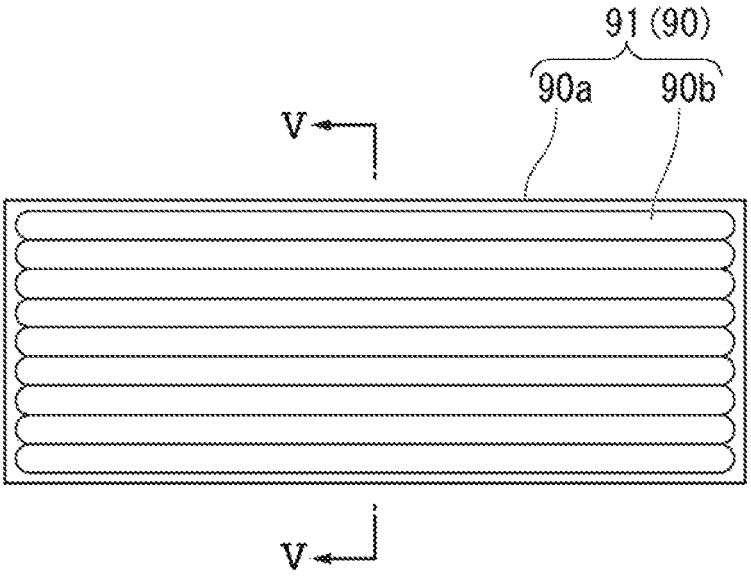
FIG. 4 is a plan view of a uniform heating member to be disposed within the heat roller.
Figure 5:
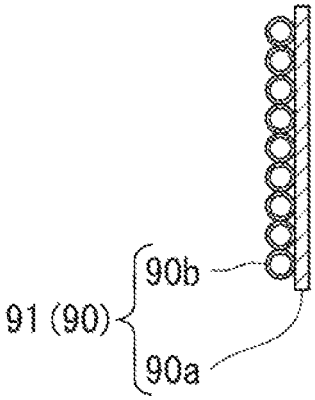
FIG. 5 is a cross sectional diagram of the uniform heating member taken along the line V-V of FIG. 4.

FIG. 4 is a plan view of the uniform heating member 90 according to the first embodiment. FIG. 5 is a cross sectional view of the uniform heating member 90 taken along the line V-V of FIG. 4. The first uniform heating member 91 is illustrated in FIGS. 4 and 5. The second uniform heating member 92 is configured in the same manner as the first uniform heating member 91, and depiction of the second uniform heating member 92 is omitted. In FIG. 5, the first uniform heating member 91 is in a planar shape. The first uniform heating member 91 is bent in the arc shape illustrated in FIG. 2 when the first uniform heating member 91 is positioned in the heat roller 50.

As illustrated in FIGS. 4 and 5, the first uniform heating member 91 includes a plate 90*a* and a plurality of heat pipes 90*b*. The planar shape of the plate 90*a* is rectangular and is long in the roller width direction. The plurality of heat pipes 90*b* are connected to the plate 90*a*.

Each of the heat pipes 90*b* has a cylindrical shape which extends in the longitudinal direction of the plate 90*a*. A hydraulic fluid is sealed inside the heat pipes 90*b*. The heat pipes 90*b* transfer heat in accordance with movement of the hydraulic fluid. When there is a temperature difference between two ends of the heat pipe 90*b*, a gas-liquid transfer cycle in which the hydraulic fluid evaporates and condenses occurs. The hydraulic fluid cycles is caused within the heat pipes 90*b* by the gas-liquid transfer cycle. Heat may transfer within the heat pipes 90*b* from a higher temperature portion to a lower temperature portion due to the hydraulic fluid cycling within the heat pipes 90*b*. The heat pipes 90*b* cause the temperature of the heat roller 50 to be more uniform due to the heat transfer. Here, the inner walls of the heat pipes 90*b* may be a capillary structure.

The first uniform heating member 91 includes a heat conducting member formed of at least one of aluminum and copper. For example, the plate 90*a* is formed of aluminum. For example, the heat pipes 90*b* are formed of copper, which has higher heat conductivity and corrosion resistance than aluminum. If the heat pipes 90*b* are formed of copper, water is used as the hydraulic fluid. Since copper has higher heat conductivity than aluminum, the uniformity of the heating of the heat roller 50 is improved in comparison to a case in which the heat pipes 90*b* are formed of aluminum. Also, since copper has a higher corrosion resistance than aluminum, the corrosion resistance of the heat pipes 90*b* is improved in comparison to a case in which the heat pipes 90*b* are formed of aluminum. If the heat pipes 90*b* are formed of aluminum, acetone may be used as the hydraulic fluid.

For example, the joint between the plate 90*a* and the heat pipes 90*b* is a metal joint such as low temperature solder. Alternatively, the plate 90*a* and the heat pipes 90*b* may be joined using a silicon adhesive.

Hereinafter, a modification example of the uniform heating member will be described.

Figure 6:
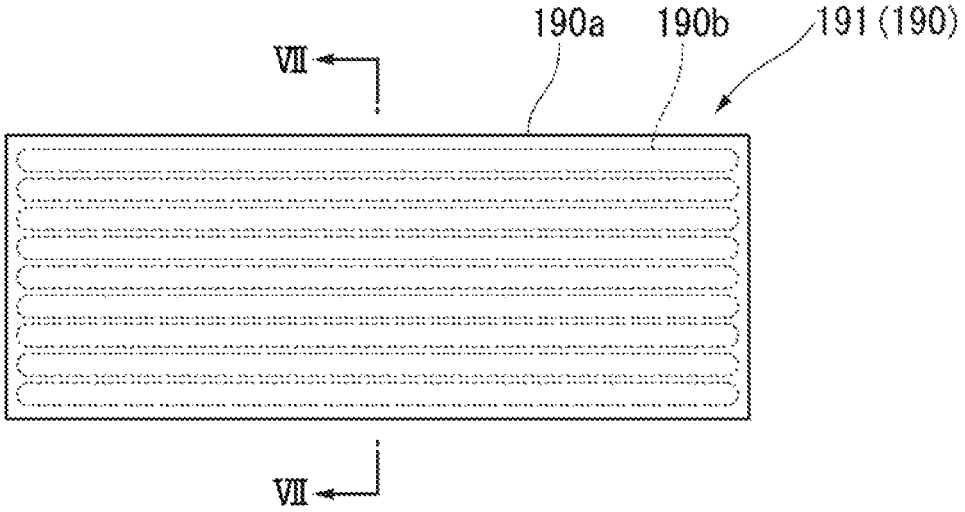
FIG. 6 is a plan view of a uniform heating member according to a modification example.
Figure 7:
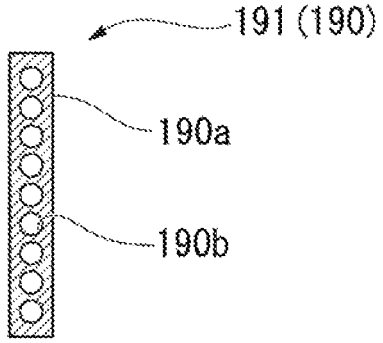
FIG. 7 is a cross sectional diagram of the uniform heating member taken along the line VII-VII of FIG. 6.

FIG. 6 is a plan view of the uniform heating member according to the modification example. FIG. 7 is a cross sectional diagram of the uniform heating member taken along the line VII-VII of FIG. 6. A first uniform heating member 191 is illustrated in FIGS. 6 and 7. The second uniform heating member is configured in the same manner as the first uniform heating member 191, and depiction of the second uniform heating member is omitted. FIG. 6 is a plan view of the uniform heating member, which corresponds to the uniform heating member illustrated in FIG. 4. FIG. 7 is a cross sectional diagram corresponding to FIG. 5.

As illustrated in FIGS. 6 and 7, the first uniform heating member 191 includes a plate member 190*a*. The planar shape of the plate member 190*a* is rectangular and is long in the roller width direction. A plurality of spaces 190*b* is formed in the plate member 190*a*. For example, a plurality of through holes which penetrates the plate member 190*a* in the longitudinal direction is formed using extrusion or the like. After forming the plurality of through holes, the plurality of spaces 190*b* is formed by crushing both end portions of the plate member 190*a*. The spaces 190*b* extend in the longitudinal direction of the plate member 190*a*. A hydraulic fluid is sealed inside the spaces 190*b*.

For example, the plate member 190*a* is formed of a metal such as aluminum. If the plate member 190*a* is formed of aluminum, acetone is used as the hydraulic fluid. Since aluminum has higher heat conductivity than iron, the uniformity of the temperature in the heat roller 50 is improved in comparison to a case in which the plate member 190*a* is formed of iron.

The plate member 190*a* may be formed of copper, which has higher heat conductivity and corrosion resistance than aluminum. If the plate member 190*a* is formed of copper, water is preferably used as the hydraulic fluid. Since copper has higher heat conductivity than aluminum, the uniformity of the temperature in the heat roller 50 is improved in comparison to a case in which the plate member 190*a* is formed of aluminum. Also, since copper has higher corrosion resistance than aluminum, the corrosion resistance of the plate member 190*a* is improved in comparison to a case in which the plate member 190*a* is formed of aluminum.

Hereinafter, disposition of the uniform heating member 90 relative to the heat roller 50 will be described with reference to FIG. 8.

Figure 8:
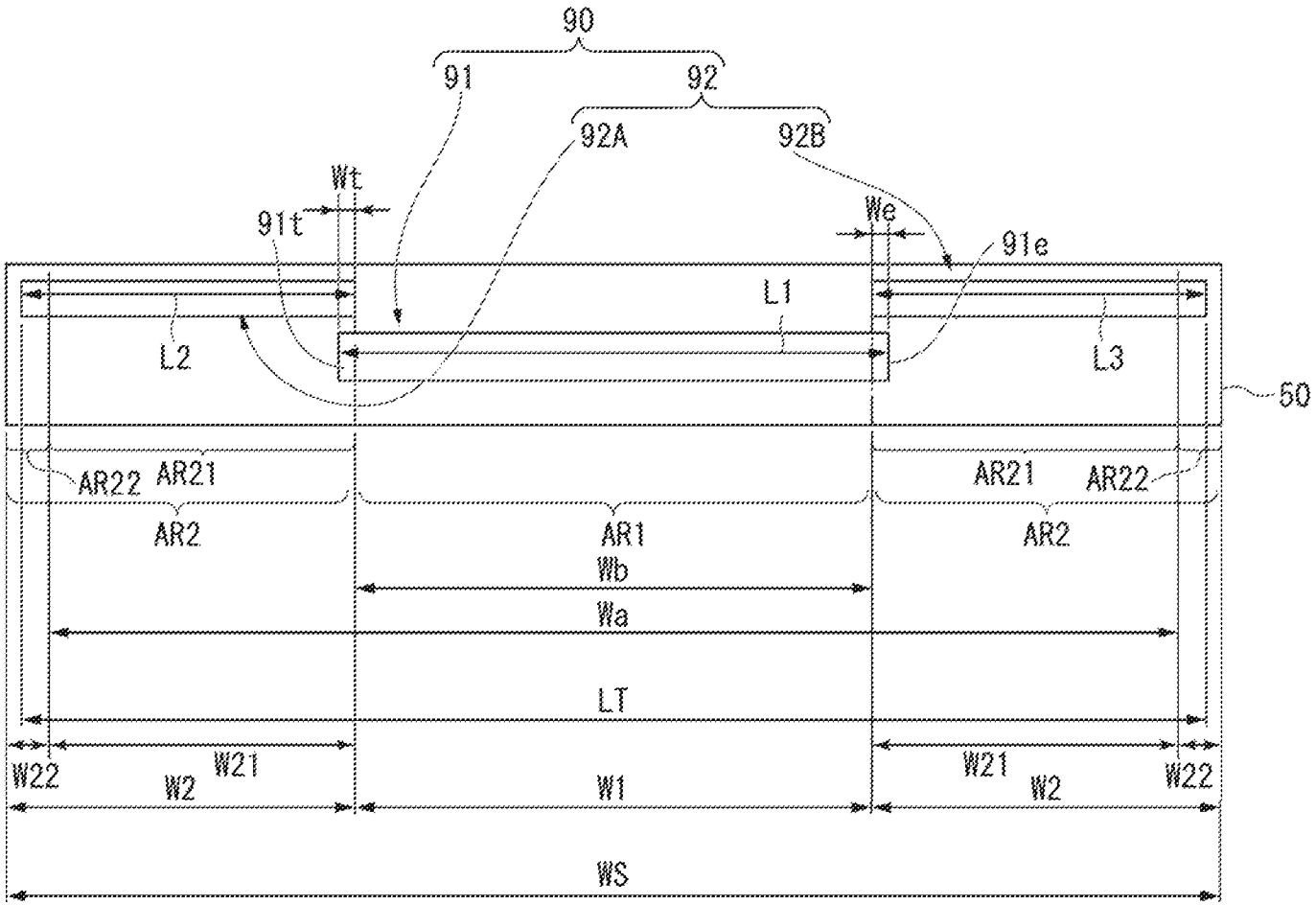
FIG. 8 illustrates disposition of the uniform heating member relative to the heat roller according to the first embodiment.

FIG. 8 illustrates the disposition of the uniform heating member 90 according to the first embodiment.

As illustrated in FIG. 8, the first uniform heating member 91 is positioned in the center of the heat roller 50 in the roller width direction. The second uniform heating member 92 includes a first divided unit 92A and a second divided unit 92B. Of the end portions of the heat roller 50 in the roller width direction, the first divided unit 92A is positioned at a first end portion. Of the end portions of the heat roller 50 in the roller width direction, the second divided unit 92B is positioned at a second end portion.

The regions of the heat roller 50 which line up in the roller width direction include a paper passage region AR1 and two adjacent regions AR2. The paper passage region AR1 is a region through which the sheet P passes. The adjacent regions AR2 are regions adjacent to the paper passage region AR1 in the roller width direction. Here, the paper passage region AR1 may be referred to as a "first region." The adjacent region AR2 may be referred to as a "second region."

The paper passage region AR1 is positioned in the center of the heat roller 50 in the roller width direction. The adjacent regions AR2 are positioned at both end portions of the heat roller 50 in the roller width direction.

Each of the adjacent regions AR2 includes a first adjacent region AR21 and a second adjacent region AR22. The second adjacent region AR22 is a region through which paper does not pass regardless of the size of the paper. The first adjacent region AR21 and the second adjacent region AR22 are arranged in the roller width direction of the heat roller 50. The first adjacent region AR21 is closer to the paper passage region AR1 than the second adjacent region AR22. The first adjacent region AR21 is adjacent to the paper passage region AR1. The second adjacent region AR22 is adjacent to the first adjacent region AR21. The second adjacent region AR22 is positioned at both end portions of the heat roller 50 in the roller width direction.

Hereinafter, of the sheets P which are used, the sheet P which is longest in the roller width direction will be referred to as a "large sheet" Of the sheets P which are used, the sheet P which is shortest in the roller width direction will be referred to as a "small sheet." A length Wa of the large sheet in the roller width direction will be referred to as "large sheet width." A length Wb of the small sheet in the roller width direction will be referred to as "small sheet width."

For example, the large sheet width Wa is the same as a width of the short side of a sheet of A3 size. For example, the small sheet width Wb is the same as the width of the short side of a sheet of A4 size (hereinafter, "A4R width"). Note that, the small sheet width Wb may be the same as the width of the short side of postcard paper. The large sheet width Wa and the small sheet width Wb may be different according to design specifications of the fixing device 34.

Further, a length W1 of the paper passage region AR1 in the roller width direction is referred to as "paper passage region width." A length W2 of the adjacent region AR2 in the roller width direction is referred to as "adjacent region width." A length W21 of the first adjacent region AR21 in the roller width direction is referred to as "first adjacent region width." A length W22 of the second adjacent region AR22 in the roller width direction is referred to as "second adjacent region width."

For example, the paper passage region width W1 is assumed to be the same as the small sheet width Wb. The adjacent region width W2 is a size obtained by adding the first adjacent region width W21 to the second adjacent region width W22. A sum of the two first adjacent region widths W21 is obtained by subtracting the small sheet width Wb from the large sheet width Wa.

For example, the adjacent region AR2 is assumed to be a region through which the small sheet does not pass. Further, the first adjacent region AR21 is assumed to be a region through which the large sheet passes, and the first adjacent region AR21 is assumed to be a region through which the small sheet does not pass. Also, the second adjacent region AR22 is assumed to be a region through which both the large sheet and the small sheet do not pass.

A width WS of the heat roller 50 (hereinafter "roller width") is a sum of the paper passage region width W1 and the adjacent region width W2. The roller width WS is greater than the large sheet width Wb.

The first uniform heating member 91 avoids the adjacent region AR2 and faces the paper passage region AR1. The second uniform heating member 92 avoids the paper passage region AR1 and faces the adjacent region AR2. In other words, except for overlapping portions 91*t* and 91*e*, the first uniform heating member 91 does not face the adjacent region AR2. The second uniform heating member 92 does not face the paper passage region AR1.

The end portions of the first uniform heating member 91 include the overlapping portions 91*t* and 91*e* which overlap in the roller width direction the end portions of the second uniform heating members 92 close to the paper passage region AR1. In other words, the first end portion of the first uniform heating member 91 includes the first overlapping portion 91*t* that is located at a position same as the end portion of the first divided unit 92A in the roller width direction. Meanwhile, the second end portion of the first uniform heating member 91 includes the second overlapping unit 91*e* that is located at a position same as the end portion of the second divided unit 92B in the roller width direction.

Hereinafter, a total length LT of the first uniform heating member 91 and the second uniform heating member 92 in the roller width direction will be referred to as "uniform heating member total width." A length L1 of the first uniform heating member 91 in the roller width direction will be referred to as "first uniform heating member width." A length L2 of the first divided unit 92A in the roller width direction is referred to as "first divided unit width." A length L3 of the second divided unit 92B in the roller width direction is referred to as "second divided unit width."

The uniform heating member total width LT is larger than the large sheet width Wa. The uniform heating member total width LT is smaller than the roller width WS. The large sheet width Wa is smaller than the roller width WS. For example, the large sheet width Wa is approximately 95% of the width of the roller width WS.

The first uniform heating member width L1 is larger than the paper passage region width W1. For example, the ratio (L1/W1) of the first uniform heating member width L1 to the paper passage region width W1 is approximately 1.0 to 1.1.

Hereinafter, a length Wt of the first overlapping unit 91*t* in the roller width direction will be referred to as "first overlapping unit width." A length We of the second overlapping unit 91*e* in the roller width direction will be referred to as "second overlapping unit width." The first overlapping unit width Wt and the second overlapping unit width We are equal to each other. For example, the first overlapping unit width Wt and the second overlapping unit width We are approximately 5% of the size of the first uniform heating member width L1.

The first divided unit width L2 is smaller than the adjacent region width W2. The first divided unit width L2 is larger than the first adjacent region width W21. The position of the first end of the first divided unit 92A is closer to the center of the heat roller 50 in the roller width direction than the position of the first end of the heat roller 50 is.

The second divided unit width L3 is smaller than the adjacent region width W2. The second divided unit width L3 is larger than the first adjacent region width W21. The position of the second end of the second divided unit 92B is closer to the center of the heat roller 50 in the roller width direction than the position of the second end of the heat roller 50 is. The first divided unit width L2 and the second divided unit width L3 are equal to each other.

Here, the first uniform heating member width L1 may be smaller than or equal to the paper passage region width W1. If the first uniform heating member width L1 is smaller than or equal to the paper passage region width W1, the first divided unit width L2 may be larger than the adjacent region width W2. Alternatively, if the first uniform heating member width L1 is smaller than or equal to the paper passage region width W1, the second divided unit width L3 may be larger than the adjacent region width W2.

The first overlapping unit width Wt and the second overlapping unit width We may differ from each other. The position of the first end of the first divided unit 92A may be aligned with the position of the first end of the heat roller 50. The position of the second end of the second divided unit 92B may be aligned with the position of the second end of the heat roller 50. The first divided unit width L2 and the second divided unit width L3 may differ from each other.

Figure 9:
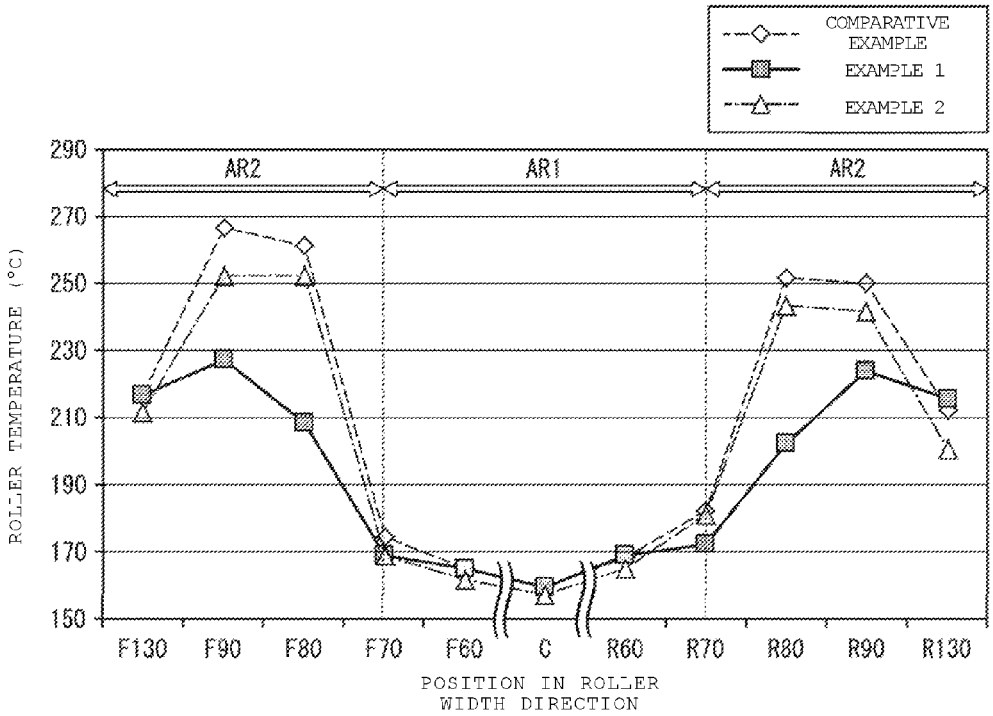
FIG. 9 is a graph illustrating temperature profile of the heat roller that includes the uniform heating member according to the first embodiment, in comparison to a comparative example.

FIG. 9 is a graph illustrating temperature profile of the heat roller 50 that includes the uniform heating member according to the first embodiment. Hereinafter, the temperature of the heat roller 50 will be referred to as "roller temperature."

In FIG. 9, the horizontal axis indicates a position in the roller width direction and the vertical axis indicates the roller temperature (° C.). The reference numeral AR1 illustrates the paper passage region which is positioned in the center of the roller width direction, when a sheet of A4R size is conveyed. The reference numeral AR2 illustrates the adjacent regions which are respectively positioned at both end portions in the roller width direction. C in the horizontal axis indicates the center in the roller width direction. F in the horizontal axis indicates the first end side in the roller width direction. R in the horizontal axis indicates the second end side in the roller width direction.

Hereinafter, an example in which the first uniform heating member 91 and the second uniform heating member 92 are formed of copper heat pipes 90*b* (refer to FIGS. 4 and 5) is referred to as "example 1,", and an example in which the first uniform heating member 91 and the second uniform heating member 92 are formed of an aluminum plate member 190*a* (refer to FIGS. 6 and 7) is referred to as "example 2." Further, an example in which the uniform heating member 90 (the first uniform heating member 91 and the second uniform heating member 92) is not provided is referred to as "comparative example."

First, the comparative example will be described. As illustrated in FIG. 9, unevenness of the roller temperature is small in the paper passage region AR1; however, unevenness of the roller temperature is great in the adjacent regions AR2. The change in the roller temperature is particularly notable at the boundary portions (positions F70 and R70 in the roller width direction) between the paper passage region AR1 and the adjacent regions AR2. The roller temperatures at the boundary portions are approximately 170° C. to 180° C. The roller temperature at a position F90 of the adjacent region AR2 is approximately 270° C. The roller temperature at a position R80 of the adjacent region AR2 is approximately 250° C. A difference of the roller temperatures between the boundary portions and the adjacent regions AR2 is approximately 70° C. to 100° C.

Next, the example 1 will be described. In the paper passage region AR1, unevenness of the roller temperature is small in the same manner as in the comparative example; however, in the adjacent regions AR2, unevenness of the roller temperature is smaller than the comparative example. Particularly, a difference of the roller temperature at the boundary portions is small in comparison to the comparative example. The roller temperatures at the boundary portions are approximately 170° C. The roller temperature at the position F90 of the adjacent region AR2 is approximately 230° C. The roller temperature at the position R80 of the adjacent region AR2 is approximately 200° C. A difference of the roller temperatures between the boundary portions and the adjacent regions AR2 is approximately 30° C. to 60° C. The temperature difference is approximately 40° C. smaller in comparison to the comparative example.

Next, the example 2 will be described. In the paper passage region AR1, unevenness of the roller temperature is small in the same manner as in the comparative example; however, in the adjacent regions AR2, unevenness of the roller temperature is smaller than the comparative example. Particularly, a difference of the roller temperature of the boundary portions is small in comparison to the comparative example. The difference in the roller temperature between the example 2 and the comparative example is smaller than the difference between the example 1 and the comparative example. The roller temperatures at the boundary portions are approximately 170° C. to 180° C. The roller temperature at the position F90 of the adjacent region AR2 is approximately 250° C. The roller temperature at the position R80 of the adjacent region AR2 is approximately 240° C. The temperature difference between the boundary portions and the adjacent regions AR2 is approximately 60° C. to 80° C. The temperature difference is approximately 10° C. to 20° C. smaller in comparison to the comparative example.

Hereinafter, operations of the fixing device 34 during warming up will be described.

As illustrated in FIG. 2, during the warming up, in the fixing device 34, the heat roller 50 is driven to rotate in the arrow u direction by rotating the press roller 51 in the arrow q direction. The ASIC 74 supplies power to the lamp 52 by turning on the lamp control circuit 121. The heat roller 50 is heated by the heat generated by the lamp 52.

Hereinafter, operations of the fixing device 34 during a fixing operation will be described.

After the heat roller 50 reaches the fixing temperature and ends the warming up, if there is a print request, the MFP 10 (refer to FIG. 1) starts a print operation. Specifically, the MFP 10 forms a toner image on the sheet P using the printer unit 18 and transports the sheet P to the fixing device 34.

The MFP 10 passes the sheet P on which the toner image is formed through the nip 54 between the heat roller 50 which already reached the fixed temperature and the press roller 51. The fixing device 34 fixes the toner image to the sheet P. While performing the fixing operation, the ASIC 74 controls the lamp control circuit 121 to maintain the heat roller 50 to be at the fixing temperature.

The heat roller 50 loses heat because the heat is transferred to the sheet P during the fixing operation. For example, if sheets are continuously passed through at a high speed, in the paper passage region AR1, a significant amount of heat is transferred to the sheets P. If heating is continued according to the paper passage region AR1 from which the heat is taken, the temperature of the adjacent regions AR2 may rise excessively.

Therefore, during the passage of small sized paper, if the fixing operation is continued, the heat in the adjacent regions AR2 may rise excessively. In order to avoid the temperature rise in the adjacent regions AR2, a heating unit (a plurality of lamps) including a plurality of heating regions may be provided. However, such a heating unit may increase a manufacturing cost and complexity of heating control.

According to the first embodiment, the fixing device 34 includes the first uniform heating member 91 and the second uniform heating member 92. The first uniform heating member 91 causes temperatures of the heat roller 50 at the paper passage region AR1 to be more uniform. The second uniform heating member 92 causes temperatures of the heat roller 50 at the adjacent region AR2 to be more uniform. The first uniform heating member 91 and the second uniform heating member 92 are arranged such that heat may transfer therebetween. Since the heat of the heat roller 50 transfers in the roller width direction due to the first uniform heating member 91 and the second uniform heating member 92 being arranged such that heat may transfer therebetween, it is possible to cause temperatures of the heat roller 50 to be more uniform in the entire roller width direction. Therefore, it is possible to suppress temperature unevenness during the passage of the paper and the temperature rise of the adjacent region AR2.

By disposing one lamp 52, it is possible to suppress the complexity of the heating control in comparison to a case in which a plurality of lamps is provided. Since it is possible to reduce the number of components in comparison to a case in which a plurality of lamps is provided, it is possible to suppress manufacturing cost. Therefore, in a lamp heating fixing method, it is possible to uniformly heat the heat roller 50 using a simple configuration.

By separating the first uniform heating member 91 from the second uniform heating member 92, it is possible to avoid the direct transfer of heat from the first uniform heating member 91 to the second uniform heating member 92. By avoiding the direct transfer of heat from the first uniform heating member 91 to the second uniform heating member 92, it is possible to selectively uniformly heat one or both of the paper passage region AR1 and the adjacent region AR2. For example, during the passage of the small paper, it is possible to uniformly heat the paper passage region AR1 while avoiding the influence of the heat of the second uniform heating member 92.

The first uniform heating member 91 avoids the adjacent region AR2 and faces the paper passage region AR1. The second uniform heating member 92 avoids the paper passage region AR1 and faces the adjacent region AR2. The end portions of the first uniform heating member 91 close to the adjacent region AR2 include the overlapping units 91*t* and 91*e* which are aligned in the roller width direction with the end portions on the paper passage region AR1 sides of the second uniform heating members 92. It is possible to transfer heat in the rotational direction u of the heat roller 50 using the overlapping units 91*t* and 91*e*. By transferring heat in the rotational direction u of the heat roller 50, even if the first uniform heating member 91 is separated from the second uniform heating member 92, it is possible to uniformly heat the paper passage region AR1 and the adjacent region AR2.

The first uniform heating member 91 and the second uniform heating member 92 include the heat pipes 90*b*. When the first uniform heating member 91 and the second uniform heating member 92 include the heat pipes 90*b*, the uniformity of the temperatures of the heat roller 50 is improved in comparison to a case in which the metal member is provided.

The first uniform heating member 91 and the second uniform heating member 92 include a heat conducting member formed of at least one of aluminum and copper. When the first uniform heating member 91 and the second uniform heating member 92 include a heat conducting member formed of at least one of aluminum and copper, the uniformity of the temperatures of the heat roller 50 is improved.

For example, the first uniform heating member 91 and the second uniform heating member 92 are formed of aluminum. Since aluminum has higher heat conductivity than iron, the uniformity of the temperatures of the heat roller 50 is improved in comparison to a case in which the first uniform heating member 91 and the second uniform heating member 92 are formed of iron.

For example, the first uniform heating member 91 and the second uniform heating member 92 are formed of copper. Since copper has higher heat conductivity than aluminum, the uniformity of the temperatures of the heat roller 50 is improved in comparison to a case in which the first uniform heating member 91 and the second uniform heating member 92 are formed of aluminum. Since copper has higher heat conductivity than aluminum, the corrosion resistance of the first uniform heating member 91 and the second uniform heating member 92 is improved in comparison to a case in which the first uniform heating member 91 and the second uniform heating member 92 are formed of aluminum.

The paper passage region AR1 is positioned in the center of the heat roller 50 in the roller width direction. The adjacent region AR2 is positioned at both ends of the heat roller 50 in the roller width direction. According to this configuration, when a center of a sheet passing therethrough is fixed, it is possible to uniformly heat the heat roller 50 using a simple configuration.

Hereinafter, a modification example of the disposition of the uniform heating member will be described.

Figure 10:
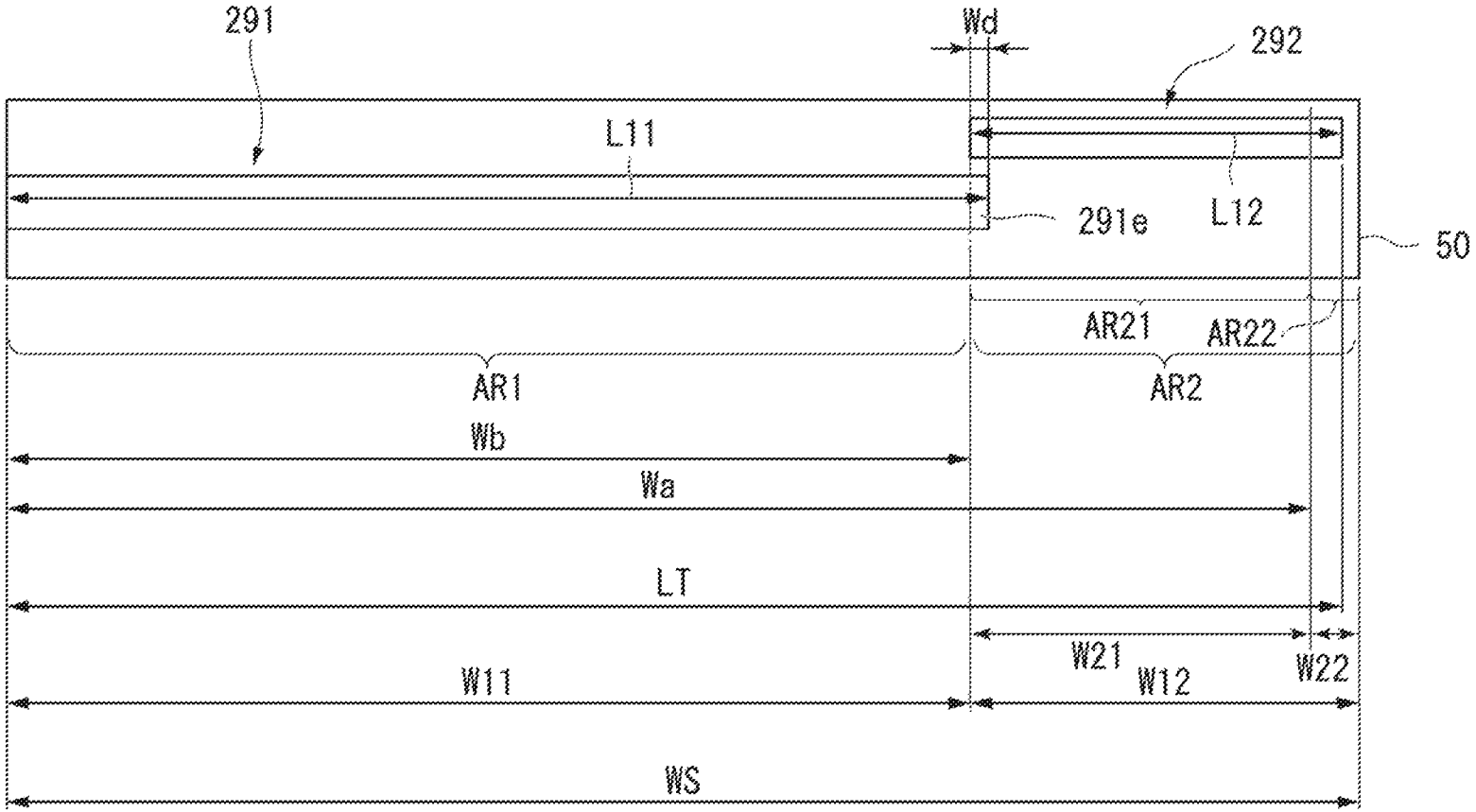
FIG. 10 illustrates disposition of the uniform heating member relative to the heat roller according to a modification example.

FIG. 10 illustrates a modification example of the disposition of the uniform heating member. The modification example, which employs a side fixed fixing method, differs from the first embodiment which employs a center fixed fixing method. In the modification example, similar configurations to those described in the first embodiment will be depicted with the same reference numerals, and detailed description thereof will be omitted.

As illustrated in FIG. 10, a first uniform heating member 291 is positioned at a first end portion of the heat roller 50 in the roller width direction. A second uniform heating member 292 is positioned at a second end portion of the heat roller 50 in the roller width direction.

Of the two end portions of the heat roller 50 in the roller width direction, the paper passage region AR1 is positioned at the first end portion. Of the end portions of the heat roller 50 in the roller width direction, the adjacent region AR2 is positioned at the second end portion. A second adjacent region AR22 is positioned at the second end portion of the heat roller 50 in the roller width direction.

Hereinafter, a length W11 of the paper passage region AR1 in the roller width direction is referred to as "paper passage region width." A length W12 of the adjacent region AR2 in the roller width direction is referred to as "adjacent region width."

Here, the paper passage region width W11 is the same as the small sheet width Wb. The adjacent region width W12 is a sum of the first adjacent region width W21 and the second adjacent region width W22. The roller width WS is a sum of the paper passage region width W11 and the adjacent region width W12.

The first uniform heating member 291 avoids the adjacent region AR2 and faces the paper passage region AR1. The second uniform heating member 292 avoids the paper passage region AR1 and faces the adjacent region AR2. In other words, except for an overlapping unit 291*e* (described later), the first uniform heating member 291 does not face the adjacent region AR2. The second uniform heating member 292 does not face the paper passage region AR1.

The end portion of the first uniform heating member 291 close to the adjacent region AR2 includes the overlapping unit 291*e* that which is aligned in the roller width direction with the end portion of the second uniform heating member 292 close to the paper passage region AR1.

Hereinafter, a length L11 of the first uniform heating member 291 in the roller width direction will be referred to as "first uniform heating member width." A length L12 of the second uniform heating member 292 in the roller width direction will be referred to as "second uniform heating member width."

The first uniform heating member width L11 is larger than the paper passage region width W11. For example, the ratio (L11/W11) of the first uniform heating member width L11 to the paper passage region width W11 is approximately 1.0 to 1.05. The position of the first end of the first uniform heating member 291 is aligned with the position of the first end of the heat roller 50.

Hereinafter, a length Wd of the overlapping unit 291*e* in the roller width direction will be referred to as "overlapping unit width." For example, the overlapping unit width Wd is approximately 5% the size of the first uniform heating member width L11.

The second uniform heating member width L12 is smaller than the adjacent region width W12. The position of the second end of the second uniform heating member 292 overlaps a portion of the heat roller 50 from the second end thereof towards the center thereof.

The first uniform heating member width L11 may be smaller than or equal to the paper passage region width W11. If the first uniform heating member width L11 is smaller than or equal to the paper passage region width W11, the second uniform heating member width L12 may be larger than the adjacent region width W12.

The position of the first end of the first uniform heating member 291 may corresponds to a position of the heat roller 50 apart from the first end thereof towards the center thereof. The position of the second end of the second uniform heating member 292 may be aligned with the position of the second end of the heat roller 50.

According to the modification example, of the end portions of the heat roller 50 in the roller width direction, the paper passage region AR1 is positioned at the first end portion. Of the end portions of the heat roller 50 in the roller width direction, the adjacent region AR2 is positioned at the second end portion. As a result, when the side fixed fixing method is employed, it is possible to cause the temperatures of the heat roller 50 to be more uniform using a simple configuration.

Hereinafter, a second embodiment will be described.

Figure 11:
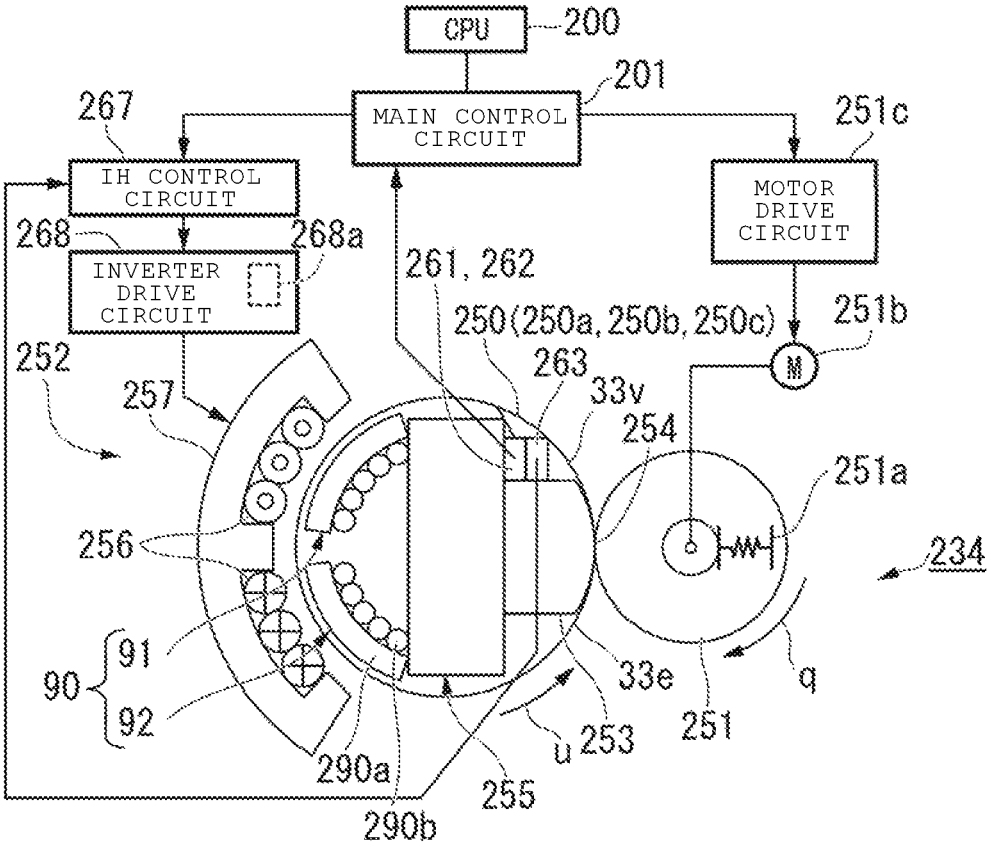
FIG. 11 schematically illustrates a fixing device according to a second embodiment.

FIG. 11 is a side view of a fixing device 234 including a control block of an IH coil unit 252 according to the second embodiment. The second embodiment, which uses an induction heating (IH), differs from the first embodiment which uses a lamp to heat the heat roller. In the second embodiment, configurations similar to those described in the first embodiment will be depicted with the same reference numerals, and detailed description thereof will be omitted.

As illustrated in FIG. 11, the fixing device 234 includes a fixing belt 250, a press roller 251, an IH coil unit 252, and the uniform heating member 90.

The fixing belt 250 is a cylindrical endless belt. A belt internal mechanism 255 which supports a nip pad 253 and the uniform heating member 90 is arranged on the inner circumferential side of the fixing belt 250.

The fixing belt 250 is driven by the press roller 251 to rotate in the direction of the arrow u. Alternatively, the fixing belt 250 may be driven independently from the press roller 251 in the direction of the arrow u. When the fixing belt 250 and the press roller 251 rotate independently of each other, a one-way clutch may be provided such that no speed difference arises between the fixing belt 250 and the press roller 251.

In the fixing belt 250, a conductive layer 250*a* and a release layer 250*c* are sequentially stacked on a base layer 250*b*. Here, the fixing belt 250 is not limited to a layered structure as long as the conductive layer 250*a* is provided.

The base layer 250*b* is, for example, formed of polyimide resin (PI). The conductive layer 250*a* is, for example, formed of a non-magnetic metal such as copper. The release layer 250*c* is—, for example, formed of a fluorine resin such as tetraflueoroethylene perfluoroalkylvinylether copolymer resin (PFA).

To warm up the fixing belt 250 rapidly, the conductive layer 250*a* is reduced in thickness and heat capacity. The fixing belt 250 with a low heat capacity reduces the time necessary for the warming up. Further, energy consumption can be reduced by reducing the time necessary for the warming up.

For example, in the fixing belt 250, the thickness of the conductive layer 250*a*, formed of copper, is set as 10 μm in order to reduce the heat capacity. For example, the conductive layer 250*a* is covered with a protective layer of nickel or the like. The protective layer of nickel or the like suppresses the oxidation of the copper layer. As a result, the protective layer of nickel or the like can improve the mechanical strength of the copper layer.

The conductive layer 250*a* may be formed by carrying out nonelectrolytic nickel plating on the base layer 250*b* which is formed of polyimide resin, and carrying out copper plating. The adhesion strength between the base layer 250*b* and the conductive layer 250*a* can be improved by carrying out the nonelectrolytic nickel plating. Also, the mechanical strength of the conductive layer 250*a* can be improved by carrying out the nonelectrolytic nickel plating.

The surface of the base layer 250*b* may be roughened by sand blasting or chemical etching. The adhesion strength between the base layer 250*b* and the nickel plating of the conductive layer 250*a* can be further improved mechanically by roughening the surface of the base layer 250*b*.

A metal such as titanium may be dispersed in the polyimide resin which forms the base layer 250*b*. The adhesion strength between the base layer 250*b* and the nickel plating of the conductive layer 250*a* can be further improved by dispersing a metal in the base layer 250*b*.

For example, the conductive layer 250*a* may be formed of nickel, iron, stainless steel, aluminum, or silver. The conductive layer 250*a* may be formed of an alloy of two or more metals, or may be formed of stack layers of two or more types of metal.

The conductive layer 250*a* of the fixing belt 250 generates an eddy current due to the magnetic flux generated by the IH coil unit 252. The conductive layer 250*a* generates Joule heat as the eddy current flows within the conductive layer 250*a* that has an electrical resistance.

The IH coil unit 252 includes a coil 256 and a core 257. The coil 256 generates a magnetic flux when a high frequency current is applied thereto. The coil 256 faces the fixing belt 250 in the thickness direction. The longitudinal direction of the coil 256 is aligned with the width direction of the fixing belt 250 (hereinafter "belt width direction").

The core 257 covers the opposite side (hereinafter "rear side") of the coil 256 from the fixing belt 250. The core 257 suppresses the magnetic flux which is generated by the coil 256 from leaking to the rear side. The core 257 focuses the magnetic flux from the coil 256 on the fixing belt 250. For example, the core 257 is formed of a magnetic material such as nickel-zinc (Ni—Zn) or manganese-nickel (Mn—Ni).

As illustrated in FIG. 11, the IH coil unit 252 generates an induced current while the fixing belt 250 is rotating in the arrow u direction. The conductive layer 250*a* of the fixing belt 250 which faces the IH coil unit 252 generates heat due to the induced current.

For example, the coil 256 is formed of ridge lines. The ridge lines are formed by bundling a plurality of lines of a copper wire material. The copper wire material is covered with a heat resistant polyimide which is an insulator. The coil 256 is formed by winding a conductive coil.

The coil 256 generates a magnetic flux in response to a high frequency current from an inverter drive circuit 268. For example, the inverter drive circuit 268 includes an insulated gate bipolar transistor (IGBT) element 268*a*.

The first uniform heating member 91 and the second uniform heating member 92 are arc-shaped along the inner circumferential surface of the fixing belt 250. The first uniform heating member 91 and the second uniform heating member 92 face the coils 256 via the fixing belt 250. The first uniform heating member 91 and the second uniform heating member 92 cause the temperature of the fixing belt 250 to be more uniform.

Hereinafter, the surfaces of the first uniform heating member 91 and the second uniform heating member 92 facing the fixing belt 250 will be referred to as "radial outer surfaces." The radial outer surfaces of the first uniform heating member 91 and the second uniform heating member 92 are apart from the inner circumferential surface of the fixing belt 250. For example, a gap between the radial outer surfaces of the first uniform heating member 91 and the second uniform heating member 92 and the inner circumferential surface of the fixing belt 250 is approximately 1 mm to 2 mm.

As illustrated in FIG. 11, the nip pad 253 is a pressing unit which presses the inner circumferential surface of the fixing belt 250 towards the press roller 251. A nip 254 is formed between the fixing belt 250 and the press roller 251. The press roller 251 is urged towards the fixing belt 250. The press roller 251 and the fixing belt 250 forms the nip 254 as the nip pad 253 and the press roller 251 press the fixing belt 250. Here, the fixing belt 250 does not move toward the press roller 251, and the position of the fixing belt 250 is fixed.

The nip pad 253 is, for example, formed of an elastic material such as silicon rubber or fluororubber. Alternatively, the nip pad 253 may be formed of a heat resistant resin such as polyimide resin (PI), polyphenylene sulfide resin (PPS), polyethersulfone resin (PES), liquid crystal polymer (LCP), or phenol resin (PF).

A sheet-shaped friction reduction member may be arranged between the fixing belt 250 and the nip pad 253. The friction reduction member is, for example, formed of a sheet member with good sliding properties and excellent abrasion resistance, and a release layer. The friction reduction member is supported by the belt internal mechanism 255 in a fixed manner. The friction reduction member is in sliding contact with the inner circumferential surface of the fixing belt 250 which is being driven. The friction reduction member may be formed of a sheet member with lubricity. The sheet member may be formed of a fiberglass sheet which is impregnated with a fluorine resin.

For example, the press roller 251 includes a heat resistant silicon sponge and a silicon rubber layer around the core metal. For example, a release layer is arranged on the surface of the press roller 251. The release layer is formed of a fluorine resin such as a PFA resin. The press roller 251 applies pressure to the fixing belt 250 using a pressure application mechanism 251*a*. The press roller 251 is a pressure application unit which applies pressure to the fixing belt 250 together with the nip pad 253. The press roller 251 rotates in the arrow q direction due to a motor 251*b*. The motor 251*b* is driven by a motor drive circuit 251*c* which is controlled by the main control circuit 201.

The center thermistor 261, the edge thermistor 262, and the thermostat 263 are positioned in a region which is surrounded by the fixing belt 250.

The center thermistor 261 and the edge thermistor 262 each detect the temperature of the fixing belt 250. The center thermistor 261 and the edge thermistor 262 each input the detection result of the temperature of the fixing belt 250 to the main control circuit 201. The center thermistor 261 is positioned at the center of the fixing belt 250 in the belt width direction.

The edge thermistor 262 is positioned outside the IH coil unit 252 in the belt width direction. The edge thermistor 262 detects the temperature of the outside of the fixing belt 250 in the belt width direction at high precision without being influenced by the IH coil unit 252.

The center thermistor 261, the edge thermistor 262 (a temperature sensor), and the thermostat 263 are positioned on the downstream side (an exit 33*v* side) of the sheet P which passes between the fixing belt 250 and the press roller 251 in the rotational direction of the fixing belt 250. That is, the center thermistor 261, the edge thermistor 262, and the thermostat 263 are positioned on the downstream side in the rotational direction u of the fixing belt 250 in relation to the nip pad 253. The center thermistor 261, the edge thermistor 262, and the thermostat 263 are positioned on the downstream side in the rotational direction u of the fixing belt 250 in relation to the first uniform heating member 91.

The first uniform heating member 91 is positioned on the downstream side (the exit 33*v* side) of the sheet P which passes between the fixing belt 250 and the press roller 251 in the rotational direction of the fixing belt 250.

The main control circuit 201 controls an IH control circuit 267 according to the detection results of the center thermistor 261 and the edge thermistor 262. According to the control of the main control circuit 201, the IH control circuit 267 controls the high frequency current which is output by the inverter drive circuit 268. The fixing belt 250 maintains various control temperature ranges according to the output of the inverter drive circuit 268.

The thermostat 263 functions as a safety device of the fixing device 234. The thermostat 263 operates when the fixing belt 250 is overheated and the temperature thereof rises to a cutoff threshold. The current to the IH coil unit 252 is cut off by the operation of the thermostat 263. The MFP 10 stops driving due to the current to IH coil unit 252 being cut off. The MFP 10 suppresses the overheating of the fixing device 234 by stopping the driving.

The thermostat 263 is positioned in the adjacent region AR2 in the belt width direction. Due to the thermostat 263 being positioned in the adjacent region AR2, the overheating of the fixing device 234 is effectively suppressed even if the temperature of the adjacent region AR2 rises.

Hereinafter, a control system 210 of the IH coil unit 252 which heats the fixing belt 250 will be described in detail.

Figure 12:
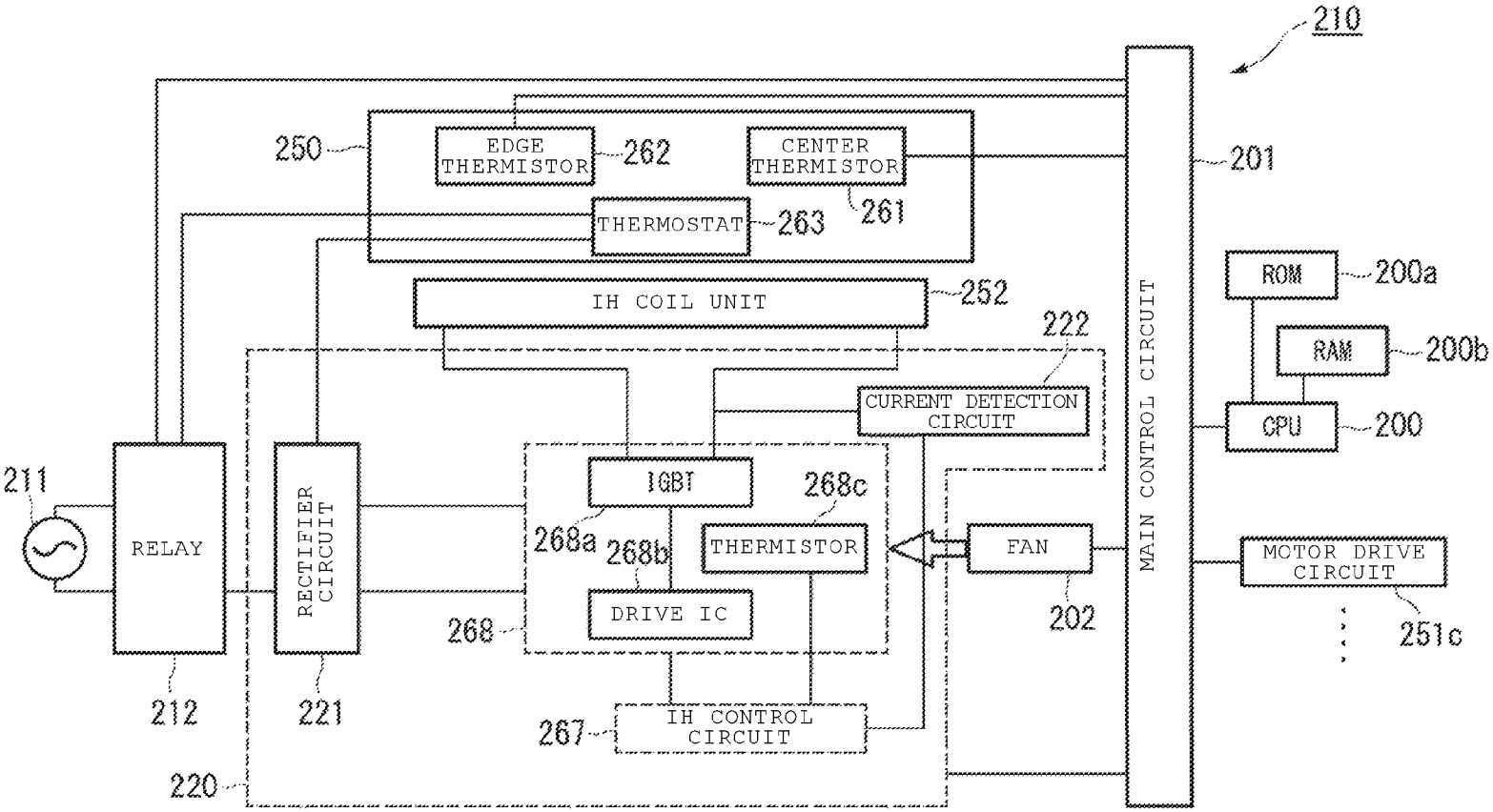
FIG. 12 is a block diagram of a control system that controls an IH coil unit in the fixing device according to the second embodiment.

FIG. 12 is a block diagram of the control system 210, which controls the IH coil unit 252 according to the second embodiment.

As illustrated in FIG. 12, the control system 210 includes a CPU 200, a read only memory (ROM) 200*a*, a random access memory (RAM) 200*b*, the motor drive circuit 201, an IH circuit 220, and the motor drive circuit 251*c*.

The control system 210 supplies power to the IH coil unit 252 using the IH circuit 220. The IH circuit 220 includes a rectifier circuit 221, the IH control circuit 267, the inverter drive circuit 268, and a current detection circuit 222.

A current is input to the IH circuit 220 from an alternating current power source 211 via a relay 212. The IH circuit 220 rectifies the current input thereto using the rectifier circuit 221 and supplies the rectified current to the inverter drive circuit 268. When the thermostat 263 operates, the relay 212 cuts off the current from the alternating current power source 211. The inverter drive circuit 268 includes a drive IC 268*b* of the IGBT element 268*a* and a thermistor 268*c*. The thermistor 268*c* detects the temperature of the IGBT element 268*a*. When the thermistor 268*c* detects a rise in the temperature of the IGBT element 268*a*, the main control circuit 201 drives a fan 202 to cool the IGBT element 268*a*.

The IH control circuit 267 controls the drive IC 268*b* according to the detection results of the center thermistor 261 and the edge thermistor 262. The IH control circuit 267 controls the drive IC 268*b* to control the output of the IGBT element 268*a*. The current detection circuit 222 transmits the detection result of the output of the IGBT element 268*a* to the IH control circuit 267. The IH control circuit 267 controls the drive IC 268*b* such that the supply of power to the coil 256 is steady using the detection result of the current detection circuit 222.

Hereinafter, the operations of the fixing device 234 during the warming up will be described.

As illustrated in FIG. 11, during the warming up, in the fixing device 234, the fixing belt 250 is driven to rotate in the arrow u direction by rotating the press roller 251 in the arrow q direction. The IH coil unit 252 generates a magnetic flux around the fixing belt 250 as the inverter drive circuit 268 applies a high frequency current. The magnetic flux of the IH coil unit 252 is guided along a magnetic path which passes through the conductive layer 250*a* of the fixing belt 250 and the conductive layer 250*a* generates heat.

The IH control circuit 267 controls the inverter drive circuit 268 based on the detection results of the center thermistor 261 or the edge thermistor 262. The inverter drive circuit 268 supplies the high frequency current to the coil 256.

Hereinafter, the operations of the fixing device 234 during the fixing operation will be described.

After the fixing belt 250 reaches the fixing temperature and ends the warming up, if there is a print request, the MFP 10 (refer to FIG. 1) starts a print operation. The MFP 10 forms a toner image on the sheet P using the printer unit 18 and transports the sheet P to the fixing device 234.

The MFP 10 passes the sheet P on which the toner image is formed through the nip 254 between the fixing belt 250 of which a temperature has already reached the fixed temperature and the press roller 251. The fixing device 234 fixes the toner image to the sheet P. While performing the fixing, the IH control circuit 267 controls the IH coil unit 252 to maintain the fixing temperature of the fixing belt 250.

The fixing belt 250 loses heat as the heat is transferred to the sheet P during the fixing operation. For example, if a plurality of sheets P is continuously passed through at a high speed, in the paper passage region AR1, a significant amount of heat is transferred to the sheets P. If heating is continued according to the paper passage region AR1 from which the heat is transferred, the temperature of the adjacent region AR2 may rise excessively.

Therefore, during the passage of small sized paper, if the fixing operation is continued, the heat in the adjacent regions AR2 may rise excessively. In order to avoid the temperature of the adjacent region AR2 rising, a heating unit (the IH coil unit) including a plurality of heating regions may be provided. However, such a heating unit may increase a manufacturing cost thereof and complexity of heating control.

In order to reduce the heat capacity and the heat-up time, the heat roller 50 may be replaced with the fixing belt 250 that includes the conductive layer 250*a*. The conductive layer 250*a* is heated using an induced current. However, since the heat capacity of the fixing belt 250 is low, the fixing belt 20 may have temperature unevenness during the paper passage and a temperature may rise too much in the adjacent region AR2. Further, in order to deal with issues such as the temperature unevenness during the paper passage and the temperature rise in the adjacent region AR2, the IH coil unit may be divided into a plurality of units. However, such an IH coil unit may lead to an increase of a manufacturing cost and temperature unevenness caused by the division of the IH coil unit.

According to the second embodiment, the fixing device 234 includes the first uniform heating member 91 and the second uniform heating member 92. The first uniform heating member 91 causes the temperature of the fixing belt in the paper passage region AR1 to be more uniform. The second uniform heating member 92 also causes the temperature of the fixing unit 250 in the adjacent region AR2 to be more uniform. The first uniform heating member 91 and the second uniform heating member 92 are arranged such that heat may transfer therebetween. Since the heat of the fixing belt 250 moves in the belt width direction due to the first uniform heating member 91 and the second uniform heating member 92 being arranged such that heat may transfer therebetween, it is possible to uniformly heat the fixing belt 250 in the roller width direction. Therefore, it is possible to suppress temperature unevenness during the passage of the paper and the temperature rise of the adjacent region AR2.

As the IH coil unit 252 is not divided, it is possible to suppress an increase in the complexity of the heating control in comparison to a case in which the IH coil unit is divided. Since it is possible to reduce the number of components in comparison to a case in which the IH coil unit is divided, it is possible to suppress the manufacturing cost. Therefore, it is possible to cause the temperature of the fixing belt 250 to be more uniform using a simple configuration.

The fixing device 234 includes the fixing belt 250 as the fixing member. The fixing device 234 includes the IH coil unit 252 as the heating unit. Therefore, in the IH method, it is possible to cause the temperature of the fixing belt 250 to be more uniform using a simple configuration.

The center thermistor 261 and the edge thermistor 262 are positioned on the downstream side (the exit 33*v* side) of the sheet P which passes between the fixing belt 250 and the press roller 251 in the sheet transfer direction. As the thermistors 261 and 262 detects the temperature of the fixing belt 250 that has been decreased because of the paper passage, the temperature of the fixing belt 250 during the passage of the paper can be estimated more precisely in comparison to a case in which the center thermistor 261 and the edge thermistor 262 are positioned on the upstream side (an entrance 33*e* side) of the sheet P which passes between the fixing belt 250 and the press roller 251 in the sheet transfer direction.

The first uniform heating member 91 is positioned on the downstream side (the exit 33*v* side) of the sheet P which passes between the fixing belt 250 and the press roller 251 in the sheet transfer direction. As the first uniform heating member 91 can start to cause the temperature of the fixing belt 250 to be uniform earlier, the temperature of the fixing belt 250 can be more uniformized in the paper passage region AR1 in comparison to a case in which the first uniform heating member 91 is positioned on the upstream side (the entrance 33*e* side) of the sheet P which passes between the fixing belt 250 and the press roller 251.

According to at least one of the embodiments described above, the fixing device 34 includes the first uniform heating member 91 and the second uniform heating member 92. The first uniform heating member 91 causes the heat roller 50 or the fixing belt 250 in the paper passage region AR1 to be more uniform. The second uniform heating member 92 causes the heat roller 50 or the fixing belt 250 in the adjacent region AR2 to be more uniform. The first uniform heating member 91 and the second uniform heating member 92 are arranged such that heat may transfer therebetween. Since the heat of the heat roller 50 transfers in the roller width direction due to the first uniform heating member 91 and the second uniform heating member 92 being arranged such that heat may transfer therebetween, it is possible to uniformly heat the entire heat roller 50 or the entire fixing belt 250 in the roller (belt) width direction. Therefore, it is possible to suppress temperature unevenness during the passage of the paper and the temperature rise in the adjacent region AR2.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device, comprising:

a fixing rotator that heats a sheet to fix an image on the sheet;

a heater that heats the fixing rotator; and a heat conductor that includes a first heat conduction member disposed adjacent to a first region of the fixing rotator that is not in contact with the sheet during heating thereof and a second heat conduction member facing a center of the fixing rotator in a width direction thereof and disposed adjacent to a second region of the fixing rotator that is in contact with the sheet during heating thereof, each of the first and second heat conduction members including a base having a plurality of spaces extending along the width direction of the fixing rotator and liquid contained in the spaces.

2. The fixing device according to claim 1, wherein the heat conductor further includes a third heat conduction member that is not in contact with the sheet during heating thereof and includes a base having a plurality of spaces extending along the width direction of the fixing rotator and liquid contained in the spaces of the third heat conduction member, the first heat conduction member and the third heat conduction member being disposed in opposite ends of the second heat conduction member in the width direction.

3. The fixing device according to claim 1, wherein the base is formed of copper or aluminum.

4. The fixing device according to claim 1, wherein the liquid is water or acetone.

5. The fixing device according to claim 1, wherein the first heat conduction member is disposed downstream with respect to the second heat conduction member along a rotational direction of the fixing rotator.

6. The fixing device according to claim 1, further comprising:

a pressing rotator urged against the fixing rotator, a nip being formed between the fixing rotator and the pressing rotator, wherein the first heat conduction member is disposed closer to an upstream end of the nip than a downstream end of the nip in a rotational direction of the fixing rotator, and the second heat conduction member is disposed closer to the downstream end of the nip than the upstream end of the nip in the rotational direction of the fixing rotator.

7. The fixing device according to claim 1, wherein an end portion of the first heat conduction member and an end portion of the second heat conduction member overlap in the width direction of the fixing rotator.

8. The fixing device according to claim 1, wherein a width of the second heat conduction member is greater than a minimum width of sheets heatable by the fixing rotator and smaller than a maximum width of sheets heatable by the fixing rotator.

9. The fixing device according to claim 1, wherein the heater is disposed in the fixing rotator and generates heat.

10. The fixing device according to claim 1, wherein the heater is disposed outside the fixing rotator and generates an induction current in the fixing rotator to cause heating thereof.

11. An image forming apparatus, comprising:

an image forming device configured to form an image on a sheet; and a fixing device configured to fix the image on the sheet, wherein the fixing device includes:

a fixing rotator configured to heat the sheet to fix the image;

a heater configured to heat the fixing rotator; and a heat conductor that includes a first heat conduction member disposed adjacent to a first region of the fixing rotator that is not in contact with the sheet during heating thereof and a second heat conduction member facing a center of the fixing rotator in a width direction thereof and disposed adjacent to a second region of the fixing rotator that is in contact with the sheet during heating thereof, each of the first and second heat conduction members including a base having a plurality of spaces extending along the width direction of the fixing rotator and liquid contained in the spaces.

12. The image forming apparatus according to claim 11, wherein the heat conductor further includes a third heat conduction member that is not in contact with the sheet during heating thereof and includes abase having a plurality of spaces extending along the width direction of the fixing rotator and liquid contained in the spaces of the third heat conduction member, the first heat conduction member and the third heat conduction member being disposed in opposite ends of the second heat conduction member in the width direction.

13. The image forming apparatus according to claim 11, wherein the base is formed of copper or aluminum.

14. The image forming apparatus according to claim 11, wherein the liquid is water or acetone.

15. The image forming apparatus according to claim 11, wherein the first heat conduction member is disposed downstream with respect to the second heat conduction member along a rotational direction of the fixing rotator.

16. The image forming apparatus according to claim 11, wherein the fixing device further includes a pressing rotator urged against the fixing rotator, a nip being formed between the fixing rotator and the pressing rotator, the first heat conduction member is disposed closer to an upstream end of the nip than a downstream end of the nip in a rotational direction of the fixing rotator, and the second heat conduction member is disposed closer to the downstream end of the nip than the upstream end of the nip in the rotational direction of the fixing rotator.

17. The image forming apparatus according to claim 11, wherein an end portion of the first heat conduction member and an end portion of the second heat conduction member overlap in the width direction of the fixing rotator.

18. The image forming apparatus according to claim 11, wherein a width of the second heat conduction member is greater than a minimum width of sheets heatable by the fixing rotator and smaller than a maximum width of sheets heatable by the fixing rotator.

19. The image forming apparatus according to claim 11, wherein the heater is disposed in the fixing rotator and generates heat.

20. The image forming apparatus according to claim 11, wherein the heater is disposed outside the fixing rotator and generates an induction current in the fixing rotator to cause heating thereof.

* * * * *